United States Patent [19]

Dagostine

[11] 4,314,642

[45] Feb. 9, 1982

[54] CARDBOARD CONTAINER WITH RECLOSABLE TOP CLOSURE

[75] Inventor: Leslie J. Dagostine, Quebec, Canada

[73] Assignee: Somerville Belkin Industries Limited, London, Canada

[21] Appl. No.: 177,573

[22] Filed: Aug. 13, 1980

[51] Int. Cl.[3] ..... B65D 5/54; B65D 65/28

[52] U.S. Cl. ..... 206/621; 229/17 R

[58] Field of Search ..... 206/621, 625; 229/17 R

[56] References Cited

U.S. PATENT DOCUMENTS

| | | | |
|---|---|---|---|
| 2,743,164 | 7/1953 | Clark | 229/17 R |
| 3,047,206 | 7/1962 | Monahan | 206/621 |
| 3,162,352 | 12/1964 | Swaim | 206/621 |
| 3,549,082 | 12/1970 | Simpson | 206/621 |
| 3,946,937 | 3/1976 | Forbes | 206/621 |
| 4,078,715 | 3/1978 | Larsson | 229/17 R |
| 4,194,632 | 3/1980 | Dutcher | 229/17 R |

*Primary Examiner*—Herbert F. Ross

*Attorney, Agent, or Firm*—Fetherstonhaugh & Co.

[57] ABSTRACT

The invention is a container having a sealed top closure that can be reclosed after opening. It is made from cardboard so that it can be automatically loaded with contents and has a top closure formed from panels on the side and end walls that can be articulated to a closed position to locate lips on the panels in a juxtaposed position wherein they can be heat sealed. Removal of a tie tab from one closure lip opens the container. Operation of a tucked under reclosure tab on another closure lip is used to reclose the opening of the initial opening.

4 Claims, 10 Drawing Figures

CARDBOARD CONTAINER WITH RECLOSABLE TOP CLOSURE

This invention relates to a cardboard container having a top closure that can be sealed when the container is initially loaded, opened to remove a portion of the contents and then conveniently reclosed.

The container has use particularly in the packaging of products such as cookies. Cookies are commonly manufactured in large volume, packed in sealed containers and widely distributed for consumption. It is important that the container should provide a seal and also be reclosable.

A very popular container for cookies is what is known as a tin tie bag. This container consists of an airtight paper bag that has a wire tie that extends along one of its top opening edges. In use the top opening of the container is rolled and the ends of the wire tie are bent around the rolled top opening. This forms an effective reclosure means for the container. The bag is made from several plys of packaging material, one of which is airtight. The end opening is usually heat sealed as the container is shipped from the cookie manufacturer. On initial use the heat seal is broken and the wire tie is used for reclosure purposes.

The wire tie cookie bag has been very successful and does have public acceptance but it has for many years suffered from the inherent disadvantage that it cannot be automatically loaded. Automatic packaging is becoming more important than ever in the overall cost of food products that are distrubuted to the public with the continually rising cost of labour. The reason that the standard paper cookie bag cannot be automatically loaded is that it is too flexible. The material of the bag will not set up with sufficient rigidity for the use in automatic loading machinery. It continues to be used however primarily because of the public acceptance for the appearance of the container. Manufacturers are inclined to suffer the higher costs of packaging as long as they possibly can because of the public acceptance of the product.

The purpose of this invention is to provide a container having the advantages and the appearance of the conventional cookie bag but also having the feature that it can be automatically loaded. Automatic loading is dependant upon a container construction that has the required physical and functional attributes but which can be made of cardboard which is rigid enough to be used in automatic packaging machinery. Automatic loading, if these conditions are met, will reduce the cost of providing a cookie container without affecting the public acceptance of the conventional cookie bag.

A container according to this invention comprises a tubular cardboard body with opposed side walls, opposed end walls, a bottom closure and a top closure; said top closure being formed from panels at the upper end of each of said side walls and end walls of said tubular body, said panels being foldably connected to each other in series around the top of the container in the open condition; each of said panels having a lip at its outer end; the side panels on the side walls being foldable from the open condition in a downward direction to meet and form a top cover with their respective lips in abutting relation and extending upwardly; the end panels of the end walls being creased to fold upon themselves and underlie the side panels with their respective lips folded upon themselves and interposed between the lips of said side panels as said top panels move downwardly to form a top cover as aforesaid; means for sealing the lips of said container when said side panels form a top cover as aforesaid; the lip on the first one of said side panels having a reclosure tab hinged thereto, said reclosure tab being folded to lie in juxtaposed relation to the inner face thereof as the side panels form a top cover, but being hingeable as aforesaid to overlie the outer face of the lip on the second one of said side panels and function as a reclosure tab; the side panel on the second side wall being formed with means to admit said reclosure tab to form a locked reclosure.

The invention will be clearly understood after reference to the following detailed specification read in conjunction with the drawings.

Figure 4:
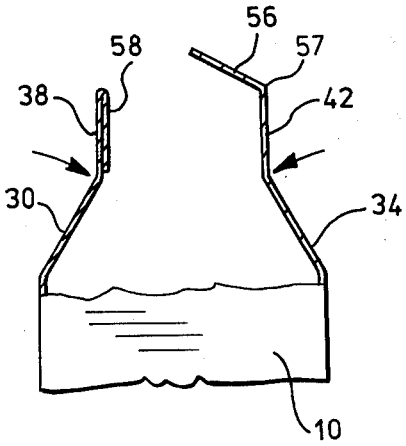
Figure 5A:
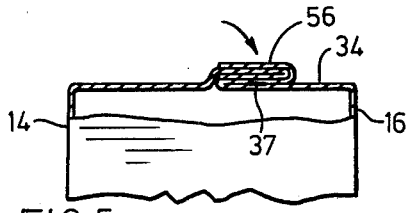
Figure 5:
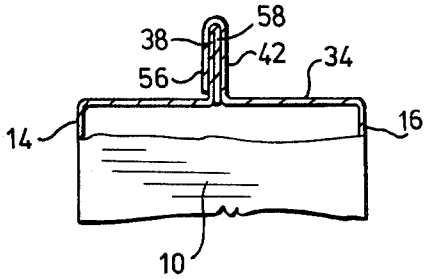
Figure 6:
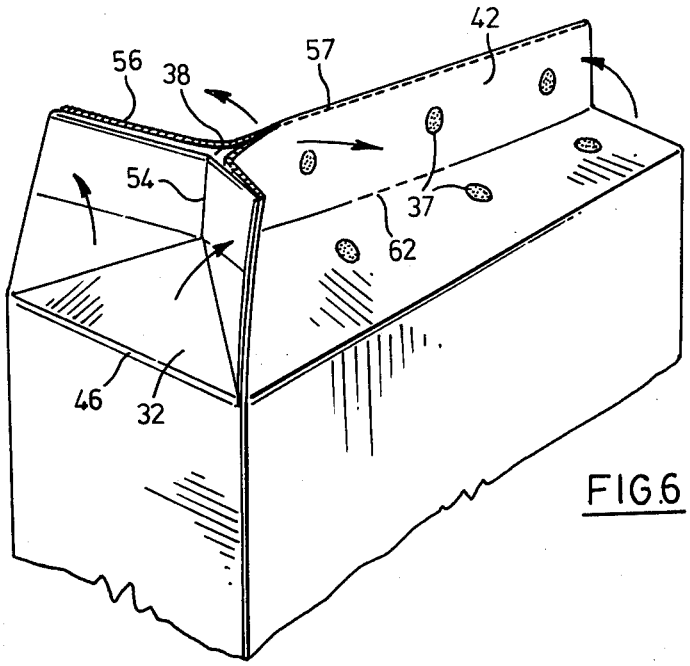
Figure 7:
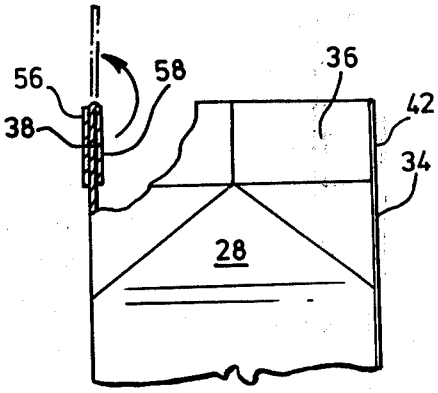
Figure 8:
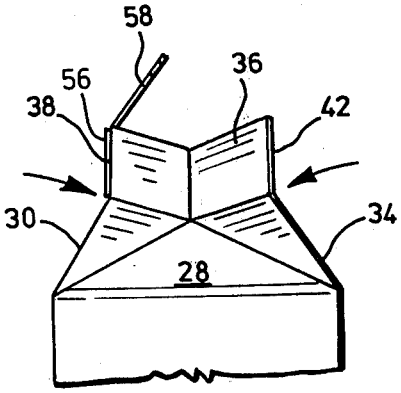
Figure 9:
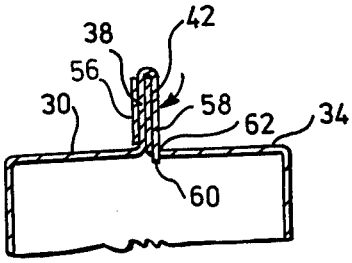

FIGS. 4 and 5 and 5*a* are sectional views further illustrating the closure;

FIG. 6 is an illustration showing the initial steps in the opening of a sealed container; and FIGS. 7, 8 and 9 are views illustrating the manner in which the opened container can be reclosed.

The blank from which the container is made is cut from cardboard and creased at fold lines in the usual manner. The blank has side walls 10 and 12, end walls 14 and 16, a wall securing tab 18, and bottom closure forming flaps 20, 22, 24 and 26 all of conventional design.

The side walls are what is often called of tubular characteristic when the tab 18 is adhesively secured to an edge of side wall 16 and the top closure is formed from panels at the upper ends of the walls that form the tubular body as will be explained. The top closure is a tubular extension of the tubular side walls.

The top closure, in the embodiment illustrated, is formed from panels 28, 30, 32 and 34 each of which has a marginal lip 36, 38, 40 and 42 respectively along its outer edge. Panels 28 and 32 are delineated at their base by fold lines 44 and 46 but no similar fold lines delineate the base of panels 30 and 34. It is preferred that these latter panels have a rounded fold line that results as the top closure is formed. This is an aesthetic consideration with the container.

Panels 28 and 32 are each formed with similar crease or fold lines as at 48, 50, 52 and 54 for the purpose of articulating the top closure to a closed position as the base sections thereof are closed as will be described later.

Numeral 56 refers to a tie tab which is hingedly connected to lip 42 by a weakened line 57 so that it can be manually separated therefrom in use as will be referred to later and numeral 58 refers to a reclosure tab which, on manufacture, is folded flat against lip 38 when the side seam 18 is glued to the panel 16. Reclosure tab 58 can be swung upwardly to form a hinged closure tab as will be described later. It has a tongue 60 that engages in a slit that can be formed by opening a perforated line 62 at the base of lip 42.

Figure 3:
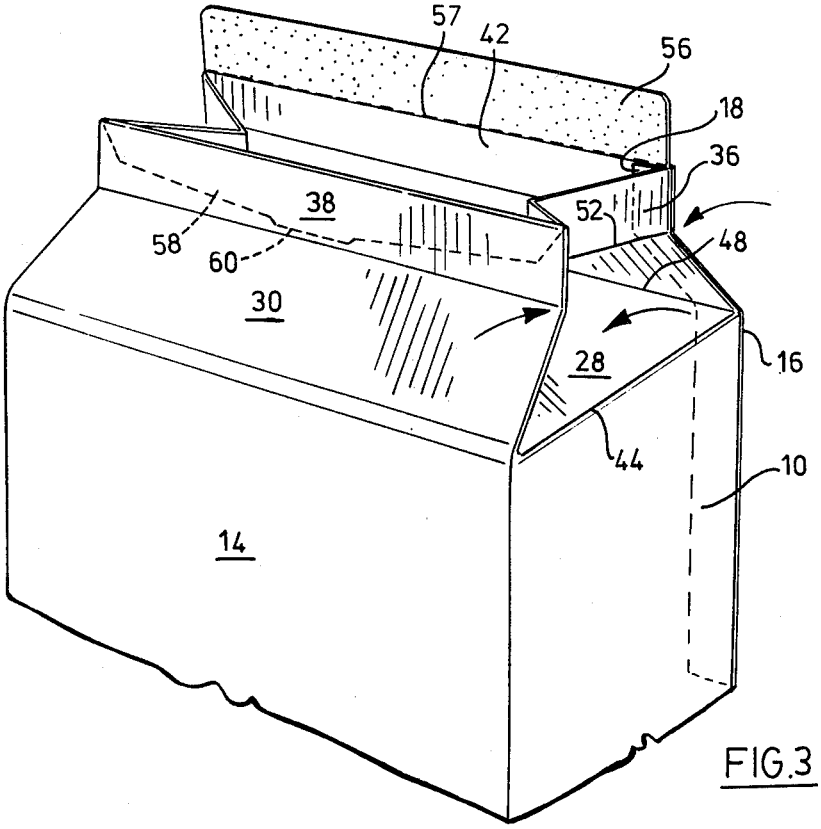
FIG. 3 is an illustration of the upper portion of the container as the top closure is being closed.

The container is tubular and is shipped from the manufacturing plant either in flat form or in tubular form wherein flap 18 is adhesively secured to a face of side wall 16 as illustrated in FIG. 3. In any event, the tubular configuration must be made before use.

In use, the tubular configuration is set up from its lay flat condition and the bottom flaps are formed into a bottom closure. This is standard practice.

Figure 1:
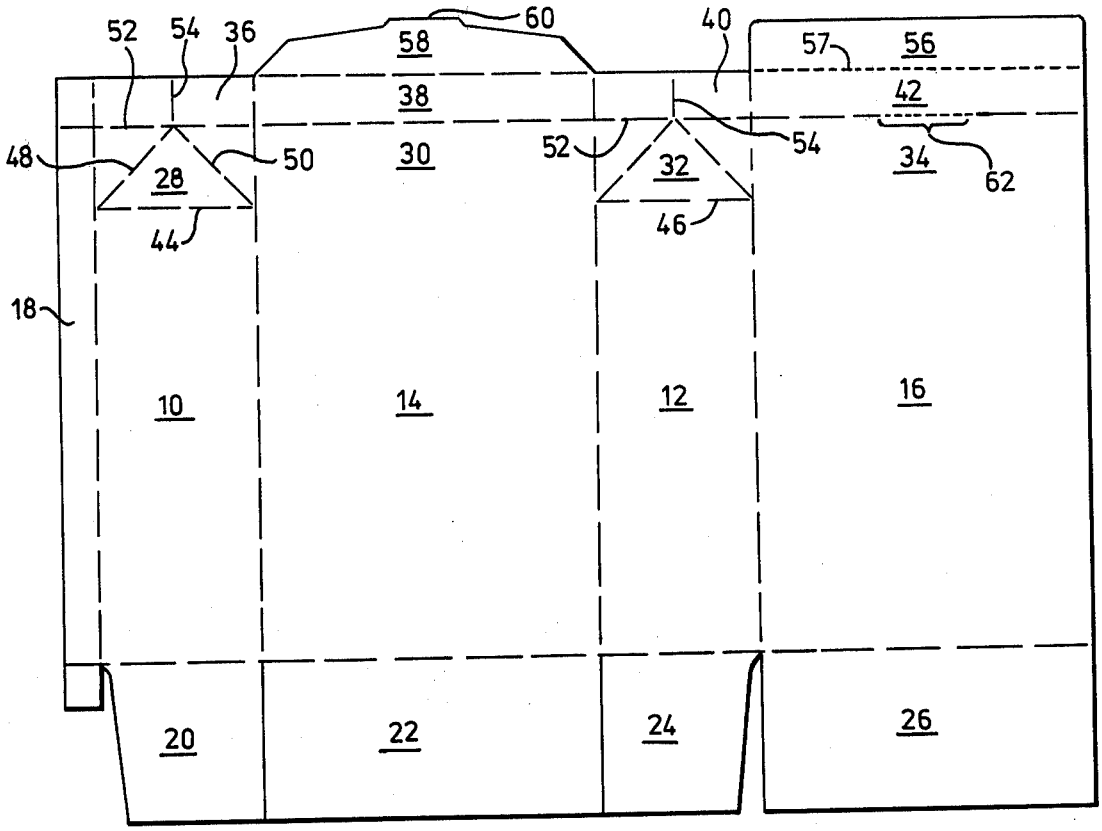
FIG. 1 is an illustration of a cardboard blank for making a container according to this invention.
Figure 2:
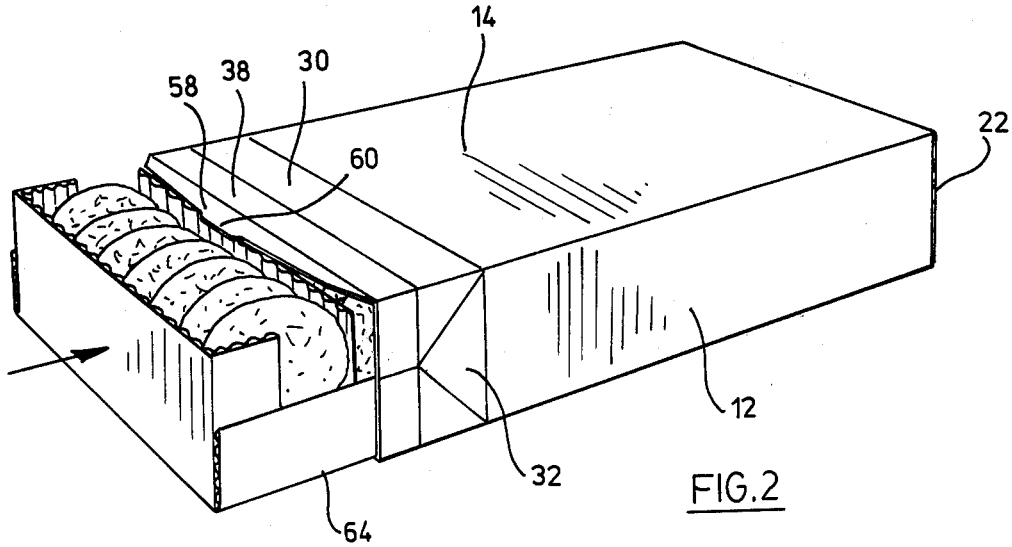
FIG. 2 is an illustration of the container as it is being loaded with a tray of cookies.

The container is cardboard and can be automatically loaded from its open tubular end. Packaging of biscuits is one contemplated use and, in such a case, the biscuits would be loaded onto a tray 64 and the loaded tray would be bodily inserted into the open end of the container as shown in FIG. 2. It will be appreciated that the container could also be loaded through the opposite end before the bottom closure is formed. The cardboard has a self-supporting characteristic that permits the container to maintain its form during automatic loading. This characteristic is not to be found in paper and for this reason paper containers of similar proportions cannot be loaded in automatic loading machinery.

Once loaded the top closure of the container would be formed. This is done by moving panels 28 and 32 downwardly and inwardly about their base hinge lines 44 and 46 respectively, as illustrated in FIG. 3. As this is done, the panels bend inwardly about their fold lines 48, 50, 52 and 54 to cause the lips 36 and 40 thereof to fold upon themselves about hinge line 54 and assume a position between the lips 38 and 42 of the side panels; and to operate the panels 30 and 34 to a closed position. FIGS. 3, 4 and 5 and 5*a* show stages in the closure of the top.

An adhesive is applied to tab 56 and it is secured thereby to lip 38 as shown in FIG. 5. The lip assembly is then folded downwardly against panel 34 and secured thereto by an adhesive 37 that is spotted on tab 56 as shown in FIG. 5*a*.

The tabs 56 and 58 are of importance to the container. The tab 56 is adhesively secured to the outside of the closed lip assembly as shown in FIG. 5*a* on initial closure. It is joined to lip 42 by means of a perforated line so that a user can remove the tab 56 from the lip assembly as will be explained.

To open the container one breaks the adhesive securement to lift the juxtaposed lips from the panel 34 as illustrated in FIG. 5*a* to assume the position illustrated in FIG. 5. As this is done the side flaps 30 and 34 will tend to rise and one can insert a finger or a thumb between the folds of the end flaps to separate the folded end flaps and raise the end portions of the side flaps. As this occurs the container tends to open and the perforated line joining the closure tab 56 and lip 42 of side flap 34 breaks as illustrated in FIG. 6. This procedure is performed at each end. By this time the perforated line joining the closure tab 56 to lip 42 has been broken at each end so that one can then break the unbroken part of the perforated line between the two breaks by means of running a finger nail along them. Alternatively, one can strip the tab 56 from the lip 38 by breaking the adhesive to remove it. The container can now be fully opened by moving the flaps to an open position. They are in tubular relation so that they move together to provide an opening for the container.

It can also be reclosed by unfolding reclosure tab 58 as illustrated in FIG. 8, maipulating the lips to juxtaposed position and folding tab 58 over the closed lip formation as shown so that the tab 60 breaks and enters perforated line 62 to lock it closed, as illustrated in FIG. 9.

When the container has been sealed as illustrated in FIG. 5*a* and lips on the closure flaps 38 and 42 are folded flat against the top of the container so that there are no projections above the flat top, the container can be easily packed, shipped and stacked on a store shelf. In this respect the container of this invention is the full equivalent of the paper container. It is an improvement in many other respects particularly because it is cardboard and it is rigid during loading as illustrated in FIG. 2 so that it can be loaded in conventional automatic packaging machinery. The appearance of the container is very difficult to distinguish from the appearance of a paper container when it is loaded. On opening it can be conveniently reclosed through the use of the reclosure tab 60 on closure flap 58 as explained above. Thus, it has overcome a long standing disadvantage without giving up any desirable quality.

The closure means described comprises a tab 56 that is glued into position and that can be removed by severing its perforated line of connection. Other closure means are possible. For example, one may replace tab 56 by means of a removable U-shaped closure molding along the upper marginal portion of the juxtaposed lips when they are in the closed position. Alternatively, staples may be applied. Still further one might heat seal the juxtaposed lips when they are in the closed position. In this connection the container is most likely made from polyethylene coated cardboard and the application of heat and pressure would cause the juxtaposed surfaces to adhere to each other in sealing relation. If such a method for closure was employed it would be necessary to apply an ab adhesive to the container surfaces that abut each other of the reclosure tab 58 and lip 38 when they are in the initial position. The ab adhesive would prevent the heat seaing means from permanently securing reclosure tab 58 to lip 38 under these circumstances. While the container is thought to have application to the packaging of cookies and it has been described as being useful for this application, it is contemplated that it would have application to the packaging of other products. It could be used in any case where a locking reclosing feature is necessary in a gable type constructed container.

Embodiments of the invention other than the one illustrated will be apparent to those skilled in the art and it is not intended that this invention should be restricted to the foregoing disclosure of a specific embodiment.

What I claim as my invention is:

1. A cardboard container comprising:

a tubular cardboard body with opposed side walls, opposed end walls, a bottom closure and a top closure;

said top closure being formed from panels at the upper end of each of said side walls and end walls of said tubular body, said panels being foldably connected to each other in series around the top of the container in the open condition;

each of said panels having a lip at its outer end;

the side panels on the side walls being foldable from the open condition in a downward direction to meet and form a top cover with their respective lips in abutting relation and extending upwardly; the end panels of the end walls being creased to fold upon themselves and underlie the side panels with their respective lips folded upon themselves and interposed between the lips of said side panels as said side panels move downwardly to form a top cover as aforesaid;

means for sealing the lips of said container when said side panels form a top cover as aforesaid;

the lip on the first one of said side panels having a reclosure tab hinged thereto, said reclosure tab being folded to lie in juxtaposed relation to the inner face thereof as the side panels form a top cover, but being hingeable as aforesaid to overlie the outer face of the lip on the second one of said side panels and function as a tongue;

the side panel on the second side wall being formed with means to admit said tongue to form a locked reclosure.

2. A cardboard container as claimed in claim 1 wherein the lip on the second one of said side panels has a tie tab hinged thereon that is adapted to fold over the outer face of the lip on the first one of said side panels for sealing relation therewith when said side panels form a top cover as aforesaid.

3. A cardboard container as claimed in claim 2 in which said means for admitting said tongue comprises a slot at the junction of said side panel and its lip.

4. A cardboard container as claimed in claim 1 in which said means for admitting said tongue comprises a slot at the junction of said side panel and its lip.

* * * * *